US005395146A

United States Patent [19]

Liu et al.

[11] Patent Number: 5,395,146

[45] Date of Patent: Mar. 7, 1995

[54] GOLF BALL PICK-UP DEVICE

[76] Inventors: John Son Liu; Lai Chemg Wei, both of P.O. Box 82-144, Taipei, Taiwan, Prov. of China

[21] Appl. No.: 258,784

[22] Filed: Jun. 13, 1994

[51] Int. Cl.[6] ..... A63B 47/02

[52] U.S. Cl. ..... 294/19.2; 221/199; 221/276

[58] Field of Search ..... 294/19.2; 56/328.1, 56/332; 221/185, 191, 194, 199, 247, 270, 276, 281, 282, 285, 289, 292, 293, 298, 303, 306

[56] References Cited

U.S. PATENT DOCUMENTS 2,203,170 6/1940 Macdonald ..... 294/19.2
3,344,955 10/1967 Ingham ..... 294/19.2 X
3,558,170 1/1971 Stanworth ..... 294/19.2
4,063,769 12/1977 Zimmer ..... 294/19.2
4,415,098 11/1983 Haas ..... 221/276 X
4,676,397 6/1987 Hoffmeister ..... 294/19.2 X

*Primary Examiner*—Johnny D. Cherry
*Attorney, Agent, or Firm*—Alfred Lei

[57] ABSTRACT

A golf ball pick-up device mainly including a casing with an open bottom, an upper transmission tube inserted into the casing, a guiding cylinder fitted over the upper transmission tube, a seat engaged with a lower end of the guiding cylinder and fixedly connected with a lower end of the casing, and a spring-loaded sliding plate slidably fitted in the recess of the seat, whereby the golf ball picked up therein can be easily dispensed as desired.

3 Claims, 4 Drawing Sheets

GOLF BALL PICK-UP DEVICE

BACKGROUND OF THE INVENTION

It has been found that the conventional golf ball pick-up device (see FIGS. 5 and 6) includes a cylinder and a tubular member with a clamp at the lower end. However, it is necessary to put the apparatus up side down in order to dispense the golf ball thereby causing much inconvenience in use.

Therefore, it is an object of the present invention to provide a golf ball pick-up device which may obviate and mitigate the above-mentioned drawback.

SUMMARY OF THE INVENTION

This invention relates to an improved golf ball pick-up device.

It is the primary object of the present invention to provide a golf ball pick-up device which can be used as a golf ball dispenser.

It is another object of the present invention to provide a golf ball pick-up device which is easy to use.

It is still another object of the present invention to provide a golf ball pick-up device which is facile to manufacture.

It is still another object of the present invention to provide a golf ball pick-up device which is simple in construction.

It is further object of the present invention to provide a golf ball pick-up device which is fit for practical use.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figures 1, 1A:
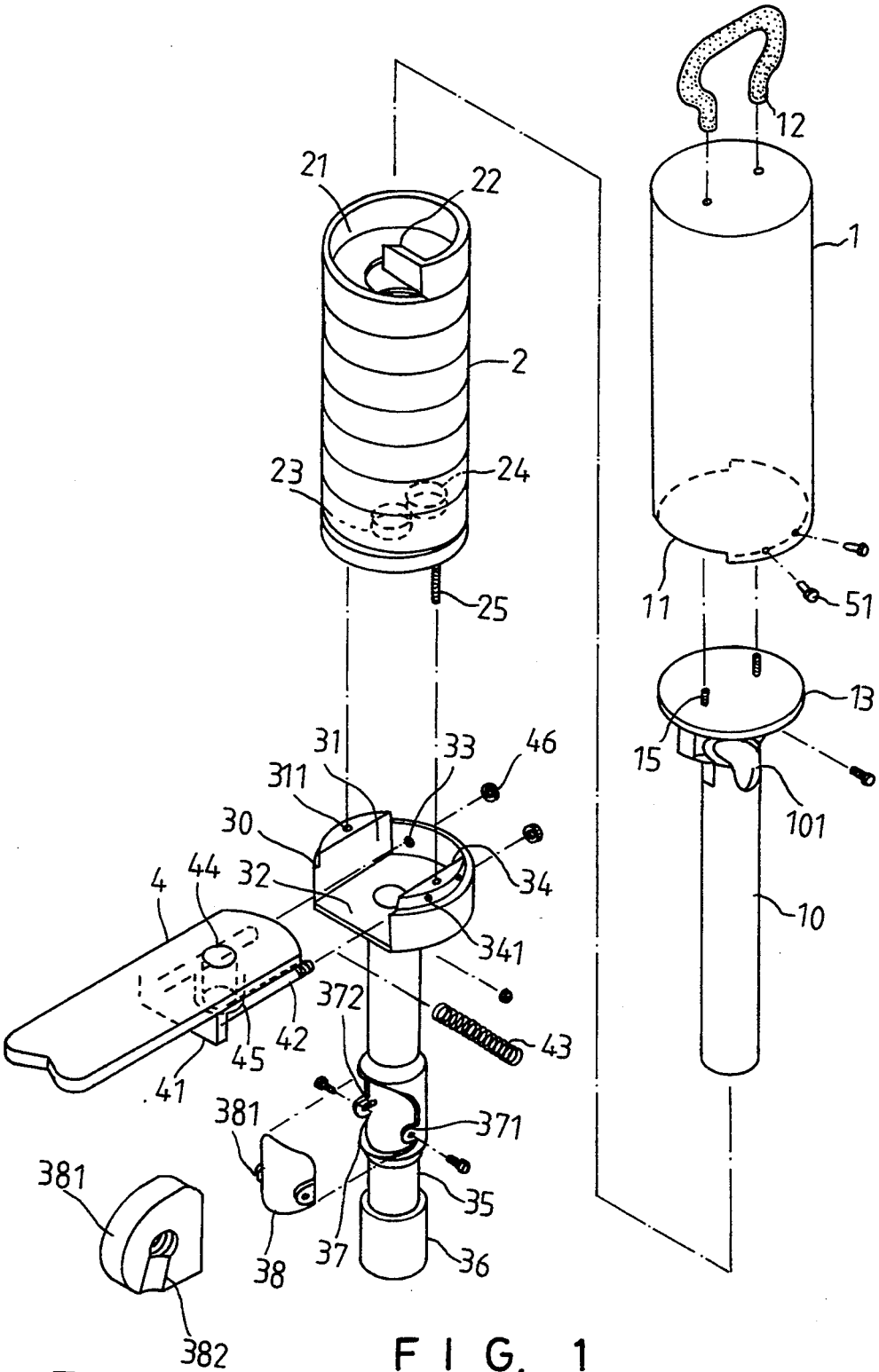
FIG. 1 is a perspective view of the present invention.
FIG. 1A is an enlarged fragmentary view of the present invention.

With reference to the drawings and in particular to FIG. 1 thereof, the golf ball pick-up device according to the present invention mainly comprises a casing 1, an upper transmission tube 10, a guiding cylinder 2, a seat 30, a lower transmission tube 35, and a sliding plate 4.

The casing 1 is a cylindrical housing formed with a recessed edge 11 at the lower end.

The upper transmission tube 10 is provided at the top with a fixing plate 13 and has a notch 101 under the fixing plate 13. Further, the lapper transmission tube 10 is inserted into the casing 1, with its fixing plate 13 fixedly engaged with the inner top end of the casing 1 by screws 15. A handle 12 is fixedly mounted on the top of the casing 1 by the screws 15.

The guiding cylinder 2 is fitted over the upper transmission tube 10, which is formed by winding an L-shaped member 21 into a cylinder with a spiral path and a central vertical passage 23. In addition, the guiding cylinder 2 is provided with a guiding portion 22 at the top and an outlet 24 at the bottom.

Figure 3:
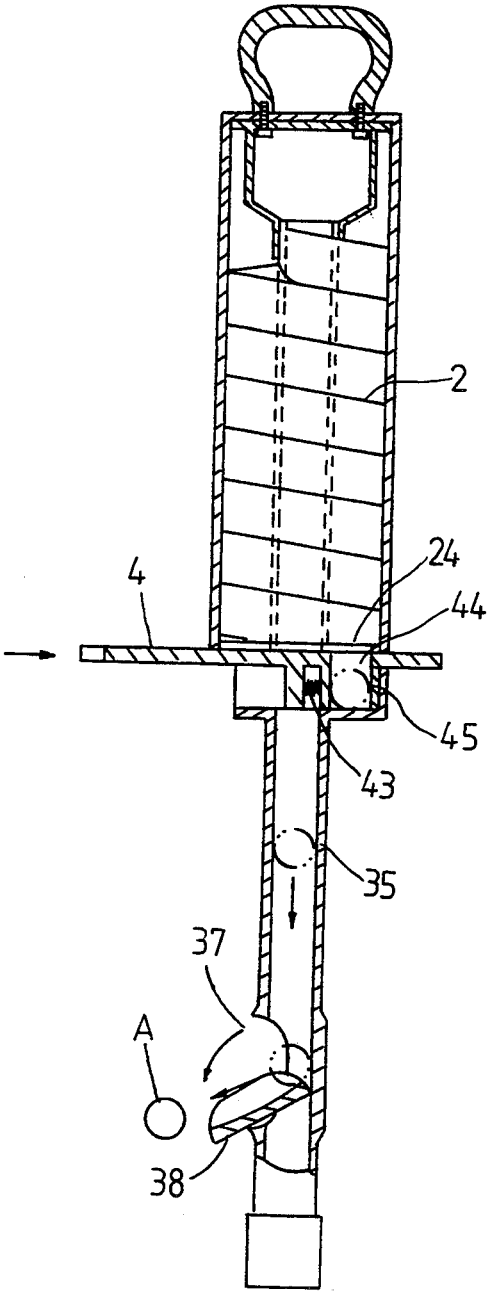

The seat 30 is formed with two parallel side walls 31 between which there is a recess 32. Between the two parallel side walls 31 there is a rear wall formed with two holes 33. The side wall 31 is formed at the top with a protuberance 34 with two threaded holes 341 at the vertical side and a threaded hole 311 on the top. The seat 30 is fixedly engaged with the lower end of the guiding cylinder 2 by screws 25 and the lower end of the casing 1 by screws 51. The bottom of the seat 30 is connected with the lower transmission tube 35 which has a clamp 36 for picking up a golf ball at the lower end. The clamp 36 may be of any conventional design well known to those skilled in the art and is not considered as a part of the invention. Further, the lower transmission tube 35 is formed with an opening 37 above the clamp 36. The opening 37 has at both sides a lug 371 having a projection 372 at the inner side. A cover 38 having two lugs 381 each formed with a groove 382 is pivotally connected with the lugs 371. The groove 382 of the lug 381 will be engaged with the projection 372 of the lug 371 when the cover 38 is fully open thereby keeping the cover 38 in position (see FIGS. 1A and 3).

The sliding plate 4 is formed with a blocking portion 41 adapted to close the recess 32 of the seat 30, a screw rod 42 at both sides, and a tubular portion having a hole 44 aligned with the transmission tube 35. The sliding plate 4 is slidably fitted in the recess 32 of the seat 30, with the screw rod 42 extending through the corresponding hole 33 of the seat 30 to engage a nut 46. Further, a coil spring 43 is fitted over the screw rod 42 so that the sliding plate 4 tends to go outward.

Figure 2:
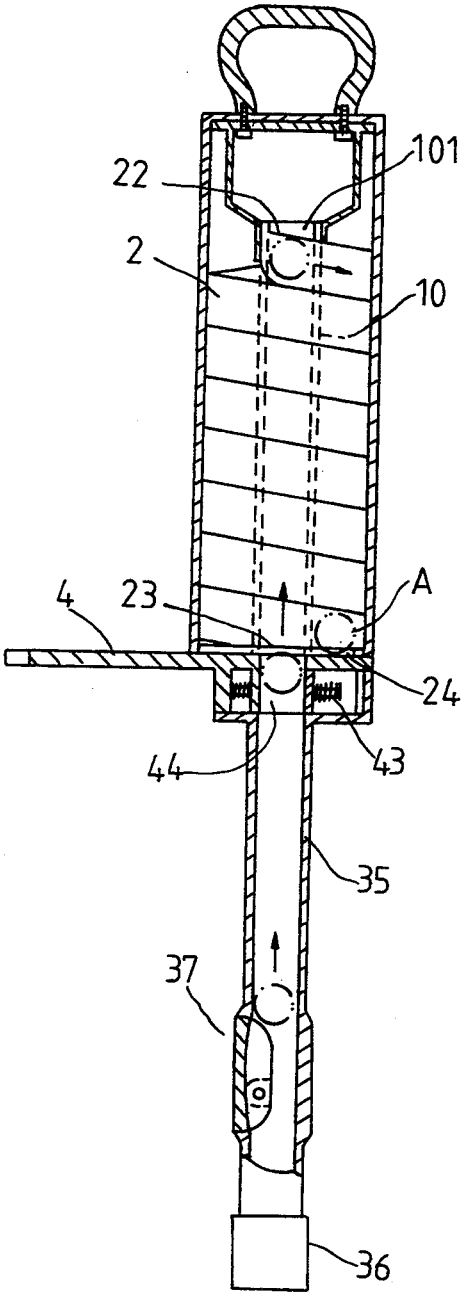
FIGS. 2 and 3 show the working principle of the present invention.

When in use (see FIGS. 2 and 3), the cover 38 is closed and the golf ball A is picked up by the clamp 36 one by one. As the golf balls A are piled up to the notch 101 of the upper transmission tube 10, the golf ball A will be guided by the guiding portion 22 of the guiding cylinder 2 to roll down the guiding cylinder 2 into the outlet 24 of the guiding cylinder 2. When desired to dispense the golf ball A, first open the cover 38 and then push the sliding plate 4 into the seat 30 thereby aligning the outlet 24 of the guiding cylinder 2 with the hole 44 of the sliding plate 4 and causing the golf ball to drop into the hole 44 of the sliding plate 4. Then, release the sliding plate 4 so that the spring 43 will push the sliding plate 4 together with the golf ball A outward thereby aligning the hole 44 of the sliding plate 4 with the lower transmission tube 35 and causing the golf ball A to drop down and go out of the exit 37.

Figure 4:
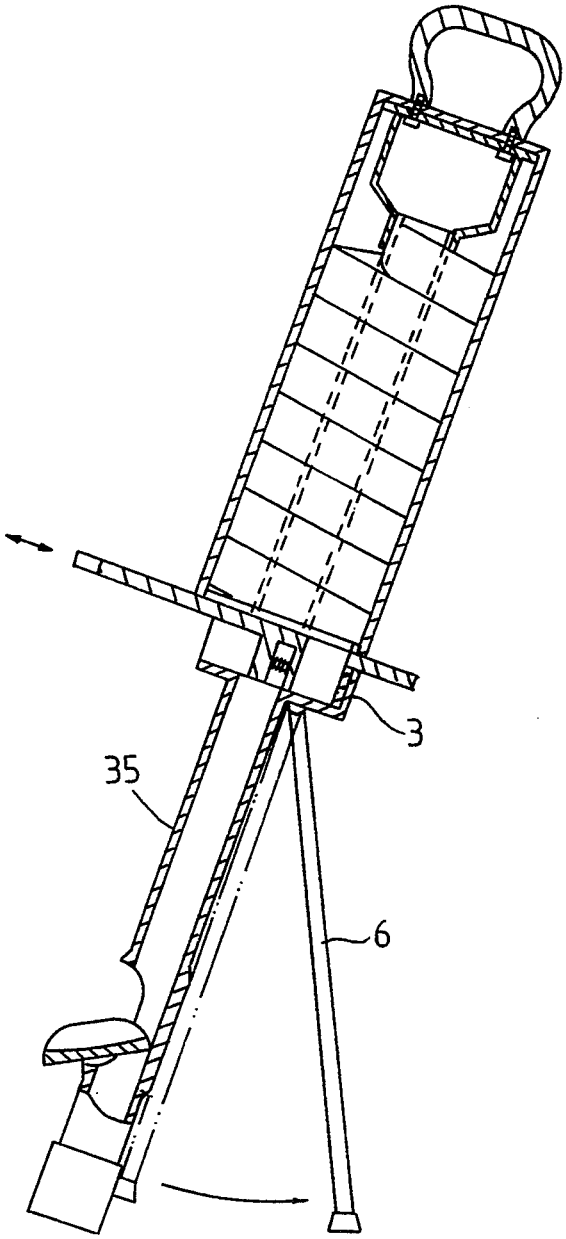
FIG. 4 shows another preferred embodiment of the present invention.
Figure 5:
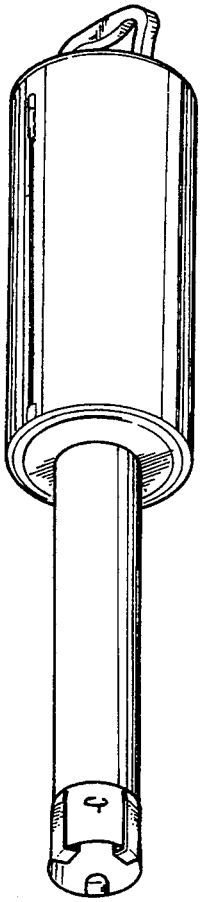
PRIOR ART FIG. 5
FIGS. 5 and 6 show a prior art golf ball pick-up device.
Figure 6:
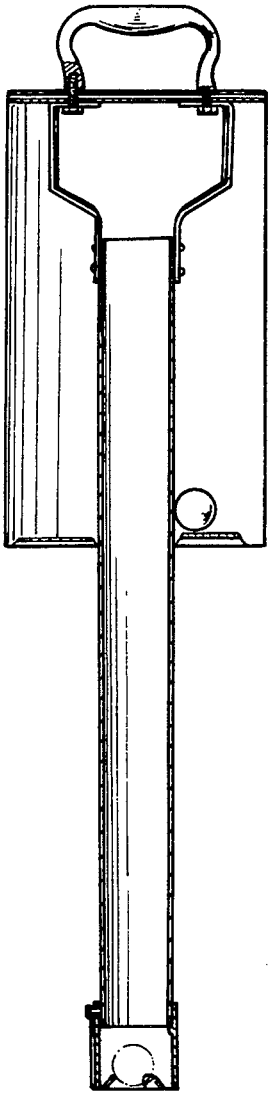
PRIOR ART FIG. 6

FIG. 4 shows a second preferred embodiment of the present invention. As illustrated, a plurality of collapsible supporting legs 6 are mounted on the bottom of the seat 30 so as to enable the golf ball pick-up device to stand on the ground firmly.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A golf ball pick-up device comprising:

a casing with an open bottom;

an upper transmission tube provided at a top with a fixing plate and having a notch under said fixing plate, said upper transmission tube being inserted into said casing;

a guiding cylinder having a spiral path, a central vertical passage, and an outlet at a bottom and fitted over said upper transmission tube;

a seat engaged with a lower end of said guiding cylinder and fixedly connected with a lower end of said casing, said seat having a recess and a bottom connected with a lower transmission tube aligned with said upper transmission tube, said seat further having a clamp at a lower end and an opening above said clamp, said opening being pivotally connected with a cover; and a spring-loaded sliding plate slidably fitted in the recess of said seat and formed with a blocking portion adapted to close the recess of said seat and a hole aligned with said lower transmission tube.

2. The golf ball pick-up device as claimed in claim 1, further comprising collapsible legs mounted on the bottom of said seat.

3. The golf ball pick-up device as claimed in claim 1, wherein the opening of said lower transmission tube is formed at both sides with a lug having a projection, and said cover is formed at both sides with a lug having a recess adapted to engage the projection.

* * * * *